US007220457B2

(12) United States Patent
Anderson

(10) Patent No.: US 7,220,457 B2
(45) Date of Patent: May 22, 2007

(54) AIR ATOMIZING ASSEMBLY AND METHOD AND SYSTEM OF APPLYING AN AIR ATOMIZED MATERIAL

(76) Inventor: Steven R. Anderson, 6720 W. Trail, Edina, MN (US) 55439

( * ) Notice: Subject to any disclaimer, the term of this patent is extended or adjusted under 35 U.S.C. 154(b) by 0 days.

(21) Appl. No.: 10/881,014

(22) Filed: Jun. 30, 2004

(65) Prior Publication Data

US 2005/0023376 A1 Feb. 3, 2005

Related U.S. Application Data

(63) Continuation-in-part of application No. 10/164,738, filed on Jun. 6, 2002, now Pat. No. 6,951,310.

(51) Int. Cl.
*B05D 5/00* (2006.01)

(52) U.S. Cl. ..... 427/421.1; 427/422; 427/426; 427/427.4; 239/406

(58) Field of Classification Search ..... 427/421.1, 427/422, 426, 427.4; 239/406
See application file for complete search history.

(56) References Cited

U.S. PATENT DOCUMENTS 1,399,006 A 12/1921 Cunerty
2,603,280 A 7/1952 Bernhard
4,255,125 A 3/1981 Auclair et al.
4,923,720 A * 5/1990 Lee et al. ..... 427/422
5,129,583 A * 7/1992 Bailey et al. ..... 239/427
5,388,764 A 2/1995 Moses
5,732,885 A * 3/1998 Huffman ..... 239/416.5
6,131,823 A 10/2000 Langeman
6,132,396 A 10/2000 Antanavich et al.
6,578,777 B2 6/2003 Bui
6,601,782 B1 8/2003 Sandholm et al.

* cited by examiner

*Primary Examiner*—Alain L. Bashore
(74) *Attorney, Agent, or Firm*—Dorsey & Whitney LLP

(57) ABSTRACT

A spray head and air atomizing assembly for providing atomizing air in an air sprayer or other delivery device in which the atomizing assembly includes converging, spiral atomizing fluid passageways. The invention also relates to a method and system for applying materials to a substrate using atomizing air as a vehicle for delivering a component to the application fluid or for conditioning the application fluid.

21 Claims, 11 Drawing Sheets

AIR ATOMIZING ASSEMBLY AND METHOD AND SYSTEM OF APPLYING AN AIR ATOMIZED MATERIAL

RELATED APPLICATION

This application is a continuation-in-part of U.S. patent application Ser. No. 10/164,738 filed Jun. 6, 2002 now U.S. Pat. No. 6,951,310.

BACKGROUND OF THE INVENTION

1. Field of the Invention

The present invention relates generally to a spray head air atomizing assembly and more specifically to an air atomizing assembly to control the flow of atomizing air in a fluid spray or other delivery device such as an air sprayer for spraying paints, adhesives, coatings, and other semi-liquid materials. The invention also relates to a method and system of spraying or applying such materials by using the atomizing air or air stream as a vehicle for delivering catalyst, an agent, moisture or other component to the application fluid and of conditioning the application fluid.

2. Description of the Prior Art

Two common types of spray or delivery devices exist for spraying or delivering a fluid to a substrate. One such device is a so-called airless type sprayer or delivery device in which an application fluid is forced through one or more nozzle openings at high pressure. With this type of device, the fluid is atomized or disbursed into tiny droplets as a result of the pressurized fluid passing through the nozzle opening.

A second such device is an air or air atomized spray gun or delivery device in which the application fluid passes through a nozzle orifice, at pressures usually much lower than the pressures employed with airless spraying, in combination with atomizing air flowing through a plurality of air orifices surrounding the nozzle opening. The atomizing air functions to atomize or disperse the application fluid after its exit from the nozzle opening.

While many of the air atomizing assemblies of the prior art are generally acceptable when being used to atomize relatively low viscosity materials such as paint which , because of their physical characteristics, are broken up and atomized easily, the performance of such assemblies is limited and less than satisfactory when used to atomize high viscosity materials (in excess of about 3,000 centipoises) and materials which have a high surface tension such as epoxies, urethanes, polyureas and other adhesives. These high viscosity and high surface tension materials are difficult to atomize and thus tend to "string" a lot as the application material travels from the spray nozzle to the substrate.

Further, in prior art air atomizing sprayers or application systems, the atomizing air has been used primarily as a means to atomize or disperse the application fluid, with the introduction of secondary reaction components or other agents, catalysts and components being accomplished via other conventional means.

Accordingly, there is a need in the art for an improved air atomizing assembly, and more particularly a need for an air atomizing nozzle assembly which provides improved atomization of both conventional low viscosity materials such as paints as well as materials which have a relatively high viscosity and/or a high surface tension such as adhesives and the like. There is also need in the art for improved methods and systems of conditioning the application fluid and introducing and mixing secondary reaction components, agents and catalysts with the application fluid.

SUMMARY OF THE INVENTION

The present invention provides an improved spray head and air atomizing assembly which overcomes many of the limitations of the prior art. This atomizing assembly is applicable to conventional low viscosity materials such as paint, but is particularly applicable to atomizing materials which have a relatively high viscosity and a high surface tension such as adhesives.

In general, the air atomizing assembly in accordance with the present invention may be used with a conventional air sprayer or other application device having a nozzle opening. Such air sprayer or application device may be provided with an application fluid supply tube or conduit for a single component material or with an elongated mixing tube for a two component material. In one embodiment, the air atomizing assembly of the present invention includes an air atomizing tip which has a generally outer conical or frustoconical surface that converges in the direction of the nozzle opening and a corresponding atomizing assembly cap which includes an inner conical or frustoconical surface that mates with a portion of the exterior conical or frustoconical surface of the atomizing tip. One of these conical or frustoconical surfaces is provided with a plurality of atomizing air flow paths or grooves which spiral along such surface as it converges. When the atomizing tip and cap are assembled so that their respective conical or frustoconical surfaces mate with one another, a plurality of air passages defined by the grooves are formed between the respective conical or frustoconical surfaces. The cross-sectional configuration of these air passages as they exit from the atomizing assembly have a generally flattened configuration and most preferably, a configuration in which the circumferential dimension of the passages is at least about twice the depth or radial dimension of such passages. Because of the generally flat shape of the air passages at the exit end of the assembly, the airflow has a shear effect on the exiting application fluid. This shear effect tends to break up and shear portions of the application fluid from adjacent portions and results in significantly improved atomization of the application fluid. This is particularly true for materials having a high viscosity and/or high surface tension.

In a further embodiment, the nozzle assembly includes means in combination with the above atomizing assembly or other atomizing assemblies for breaking up the stream of applied material prior to atomization to provide for more thorough atomization and to facilitate higher flow rates. In the preferred embodiment, this means includes providing a diverter orifice or other structure within the application fluid flow stream and/or providing a portion of the atomizing air within the application fluid flow stream itself.

In a still further embodiment, the atomizing tip and atomizing cap have exterior and interior mating surfaces, respectively, which are provided with surfaces of other than conical or frustoconical configurations to shape or control the spray pattern of the application fluid. One such other shaped surface comprises, in cross section, an elliptical configuration or a generally flattened configuration with radiused ends to provide a wider spray pattern.

The method aspect of the present invention includes utilizing the atomizing air in a conventional air atomizing sprayer or application device, or in an air atomizing sprayer or application device as described above, to provide a curing agent such as moisture, a catalyst or a secondary reaction component to the application material or to condition the application fluid. Such a method is particularly applicable to one part or two part materials which are moisture cured or which require other curing catalysts or agents. In such an application, the present invention involves introducing such moisture or other catalyst or agent as part of the atomizing air stream. Preferably, a quantity of such moisture, catalyst or agent is provided to sufficiently cure the application fluid.

A further aspect of the method in accordance with the present invention is to condition the application fluid by heating or cooling the atomizing air stream for the purpose of controlling the viscosity and/or the cure rate of the application fluid.

Details of the above and other embodiments of the apparatus and method in accordance with the present invention will become apparent with reference to the drawings, the description of the preferred embodiment and method and the appended claims.

DESCRIPTION OF THE PREFERRED EMBODIMENT

Figure 1:
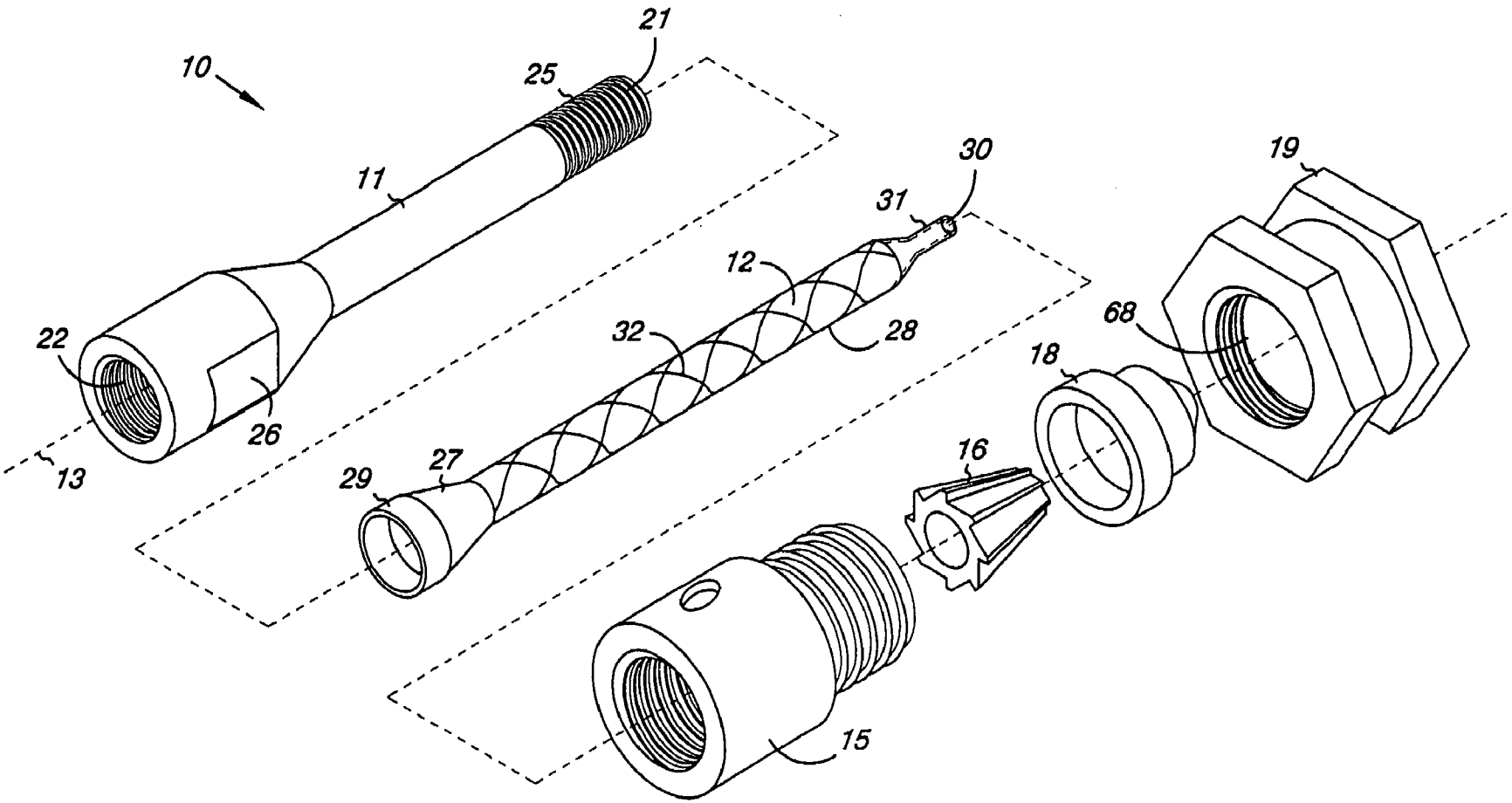
FIG. 1 is an exploded isometric view of a mixer assembly incorporating the spray head and atomizing assembly of the present invention.

One aspect of the present invention relates generally to a spray head and an air atomizing assembly incorporated therein. As will be described in greater detail below, the spray head of the present invention may be used with an application fluid mixing assembly which in turn is designed for use with an application fluid spray or delivery device such as an air atomized paint sprayer or an air atomized spray or application device. Such sprayers or other application devices are used to deliver application fluids such as paints, adhesives, sealants, semi-liquids and the like, to a substrate. In describing this aspect of the present invention, the preferred embodiment will be described with respect to an air atomized paint or other application fluid sprayer.

A further aspect of the present invention relates to a method of spraying and more specifically to a method of spraying which utilizes the atomizing air or air stream as a vehicle for providing the application fluid with a curing agent, a curing catalyst, a reaction component or other secondary material or to condition the application fluid such as by heating or cooling the atomizing air to better control the viscosity, cure rates and/or other characteristics of the application fluid. The method aspect of the present invention is usable with the specific air atomizing assembly of the present invention as well as conventional air atomizing spraying and application assemblies of the prior and future art.

A further aspect of the present invention relates to a means for breaking up the stream of applied material prior to being atomized. This aspect of the invention is also used with the specific preferred atomizing assembly of the invention as well as conventional atomizing assemblies.

Both the method and apparatus aspects of the present invention have applicability to the deliverance of both single component materials as well as two or multiple component materials to a substrate. Two or multiple component materials are commonly applied through a mixing tube or the like to thoroughly mix the components prior to application. In contrast, thorough mixing is generally not required for single component materials which are commonly cured with moisture, light or other means. Thus no mixing tube is required for single component materials, although such materials can be applied through a mixing tube, if desired. The preferred embodiment for the embodiment of FIGS. 1–14 will be described with respect to a two or multiple component material in which a mixing tube or the like is preferred. The invention, however, should not be construed as being limited to a two or multiple component system.

In the description of the present invention, terms such as forward end or rearward end may be used to describe surfaces or ends of particular elements of the invention.

Accordingly, unless otherwise stated, the forward end of an element as used herein shall be considered as the end facing or closest to the nozzle outlet end of the mixer assembly, while the rearward end of an element will be considered as the end or portion of an element which faces or is closest to the pressurized fluid inlet end of the mixer assembly.

Figure 2:
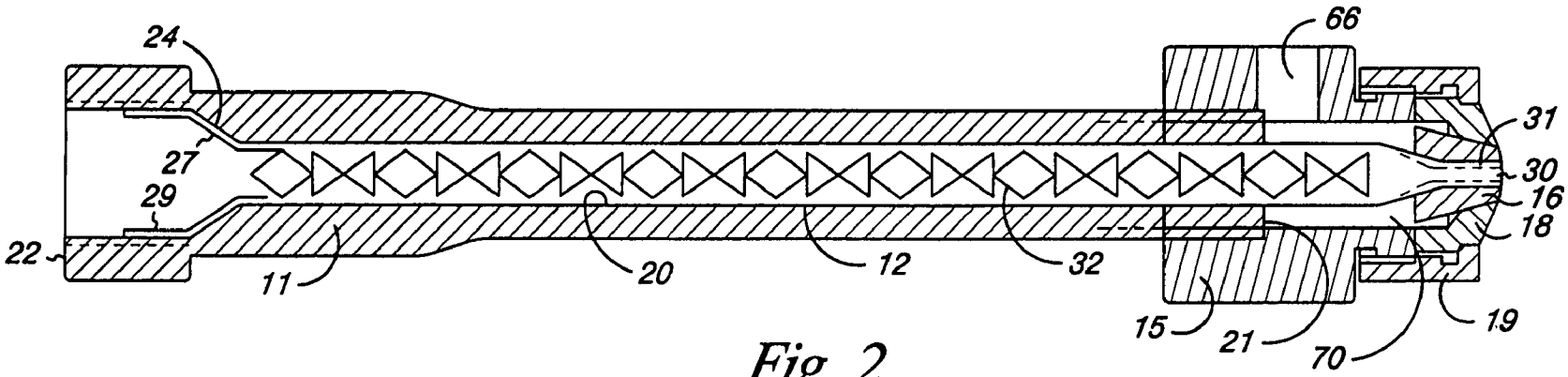
FIG. 2 is a view, partially in section, of the mixer assembly of FIG. 1 as viewed along the longitudinal axis.

With reference first to FIGS. 1 and 2, the spray head of the present invention is part of a mixer assembly 10. The mixer assembly 10 includes an elongated application fluid mixer body 11, an application fluid mixer tube 12 and an air atomizer assembly comprising the air nozzle body 15, the mixer tip 16, the air atomizing cap 18 and the retaining nut 19. The mixer body 11 is an elongated, generally tubular element having a generally cylindrical center opening 20 which extends from the forward end 21 rearwardly to an internally threaded application fluid inlet end 22. As shown best in FIG. 2, a frustoconically shaped surface portion 24 extends between the rearward end of the cylindrical opening 20 and the internally threaded portion 22. The forward end of the body 11 is provided with exterior threads 25. The exterior surface of the mixer body 11 is provided with a pair of flats 26 near the rearward end 22 to rotationally restrain the mixer body 11 during connection of elements to the threaded surfaces 22 and 25 at the rearward and forward ends of the body.

The mixer tube 12 is an elongated tubular member having an exterior cylindrical surface 28 with dimensions approximating those of the inner cylindrical opening 20. The mixer tube 12 also includes a rearwardly positioned annular surface portion 29 and a frustoconically configured exterior surface portion 27. The forward end of the tube 12 includes a narrowed, nozzle end 31 and an application fluid nozzle opening or orifice 30.

The interior of the tube 12 is generally hollow, except for internal baffle means 32 which causes the application fluid to flow in a turbulent circuitous path from its rearward end to the forward end of the nozzle opening 30. The mixer tube 12 is designed to be positioned within the mixer body so that the outer cylindrical surface 28 engages the inner cylindrical surface of the opening 20 and so that the outer frustoconical surface 27 seats against the inner frustoconical surface 24. Mixing tubes of the type illustrated in FIGS. 1 and 2 are well known to those skilled in the art and are commercially available.

Although these elements can be constructed from conventional materials such as stainless steel, brass and other metals, they may also be constructed via injection molding or the like from various plastics such as nylon, polyethylene, polypropylene or various ultra high molecular weight (UHMW) materials. This is particularly true for elements of the atomizing assembly such as the tip 16 and the cap 18.

The air atomizer assembly which is comprised of the air nozzle body 15, the mixer or atomizing tip 16, the air atomizing cap 18 and the retaining nut 19 is illustrated in exploded or combined form in FIGS. 1 and 2, with individual components being illustrated in FIGS. 4–10.

Figure 5:
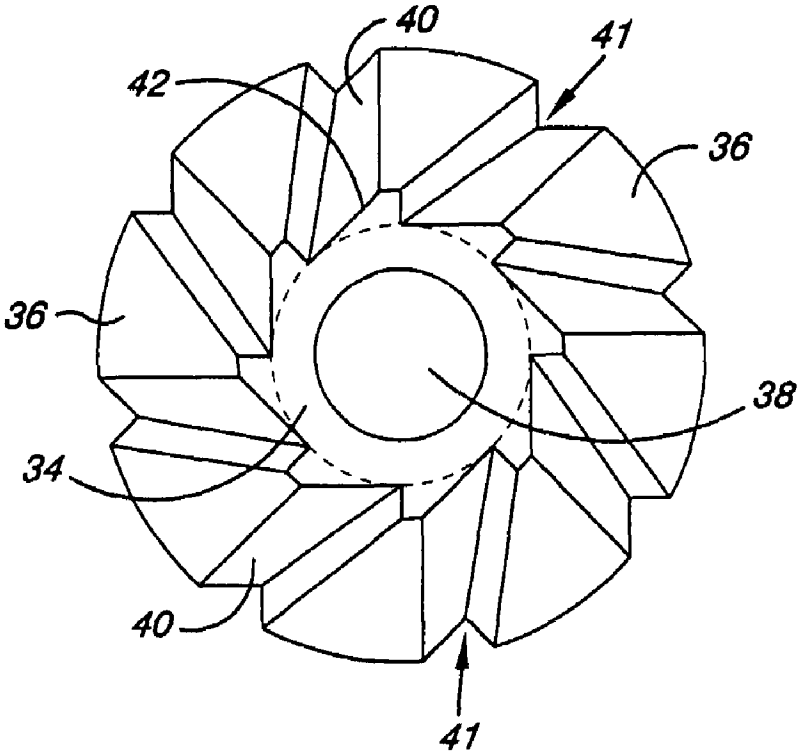
FIG. 5 is an elevational front end view of the mixer tip shown in FIG. 4.
Figure 4:
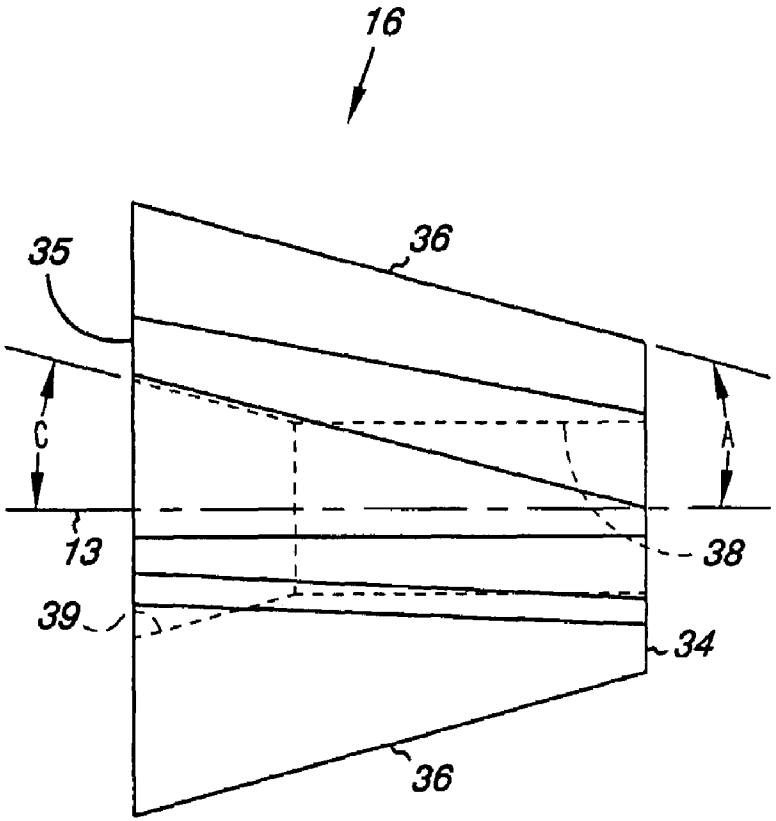
FIG. 4 is an elevational side view of the mixer tip of the air atomizer assembly of the present invention.

With specific reference to FIGS. 4 and 5, the mixer tip or air nozzle tip 16 is shown as a generally conical or frustoconical element having a forward end 34, a rearward end 35 and a generally frustoconical surface portion 36 extending between the forward and rearward ends 34 and 35. As shown, the surface 36 converges as it extends from the rearward end 35 toward the forward end 34. The frustoconical surface includes an axis of revolution 13 which is concentric with the longitudinal axis 13 of the mixer assembly 10. Both the rearward end 35 and the forward end 34 include generally planar annular portions which are oriented at right angles relative to the axis 13. With reference to FIG. 4, the frustoconical angle "A" which the surface portion 36 forms relative to the axis 13 is at least about 5 degrees, more preferably is at least about 10 degrees and most preferably is about 15 to 25 degrees.

The interior of the mixer tip 16 as shown by the broken lines in FIG. 4 includes a generally cylindrical opening 38 which extends rearwardly from the forward end 34 toward the rearward end 35 and a rearwardly positioned frustoconical surface portion 39 which extends from the rearward end of the cylindrical opening 38 to the rearward end 35. The interior surfaces 38 and 39 of the tip 16 are designed to mate with the exterior surface of the nozzle end 31 at the forward end of the mixer tube 12. Preferably, these dimensions are such as to provide a relatively tight interference fit between the surfaces of elements 31 and 38. In the preferred embodiment, the angle "C" which the frustoconical surface forms with the axis 13 matches the angle "A".

With continuing reference to FIGS. 4 and 5, the exterior frustoconical surface portion 36 is provided with a plurality of grooves or flow channels 40 which extend from the rearward end 35 to the forward end 34. As shown, these grooves or channels 40 extend from the rearward end 35 toward the forward end 34 in a generally spiral or helical pattern. The spiral angle, or the angle which each of the grooves 40 forms with a plane extending through the axis 13, is less than 30 degrees, more preferably between about 5 degrees and 25 degrees and most preferably between about 10 degrees and 20 degrees. As shown best in FIG. 5, these grooves 40 extend from the rearward end 35 to the forward end 34 and form a recess 41 in the rearward end 35 and a recess 42 in the forward end 34. The recess 42 in the forward end is shown in the enlarged view of FIG. 6. As shown, the recess 42, and thus the groove 40, includes a radial dimension "rd" and a circumferential distance "cd". The radial dimension "rd" is measured in the radial direction relative to the axis 13, while the circumferential dimension "cd" is measured in the circumferential direction relative to the axis 13.

Figure 6:
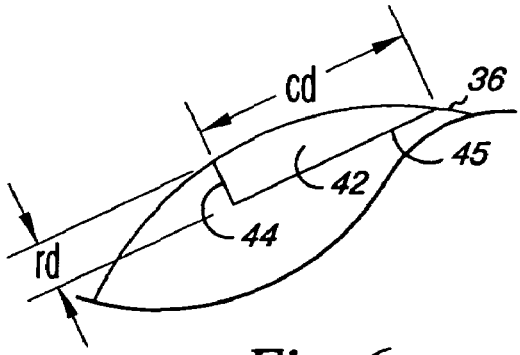
FIG. 6 is an enlarged view of one of the airflow grooves in the mixer tip.

A feature of the preferred embodiment of the present invention is that the cross-sectional configuration of the recess 42 or the groove 40 as measured at the forward end 34 has a generally flat configuration in which the circumferential dimension "cd" is greater than the radial dimension "rd". More preferably, the circumferential dimension "cd" is at least twice the radial dimension "rd" and most preferably the circumferential dimension "cd" is at least three times the radial dimension "rd". In the embodiment shown in FIGS. 4–6, the cross-sectional configuration of the recess 42 formed by the groove 40 is a generally two-sided configuration having a radial edge portion 44 and a circumferential edge portion 45. As shown in FIG. 6, the ends of the portions 44 and 45 intersect with one another and also with the frustoconical surface 36.

Figure 11:
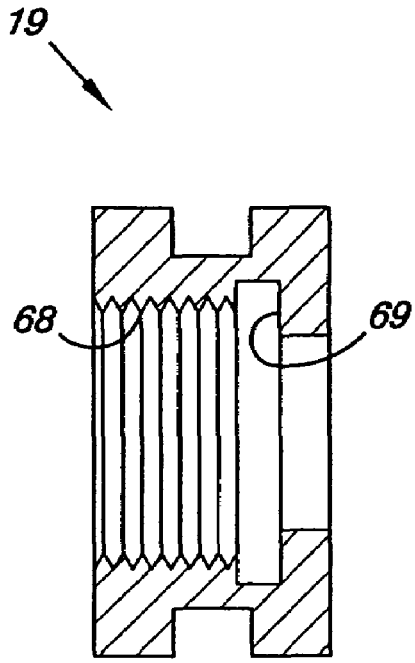
FIG. 11 is a view, partially in section, of the air atomizing cap retaining nut.

In addition to the cross-sectional configuration of the recess 42 shown in FIG. 6, such configuration can take a number of other forms as shown in FIG. 11. Specifically, the recess 42 is shown along with two other possible configurations 46 and 48. The recess 46 is shown as having two generally equal radial edges 49,49 in combination with a circumferential edge 50, while the recess 48 is shown as having two radial edges 51,51 of unequal length in combination with a circumferential edge 52. In all of these configurations, it is preferable for the recesses 42,46 and 48 to have a generally flat configuration with the circumferential dimensions being greater than the radial dimensions, more preferably at least about twice the radial dimensions, and most preferably at least about three times the radial dimensions.

Figure 7:
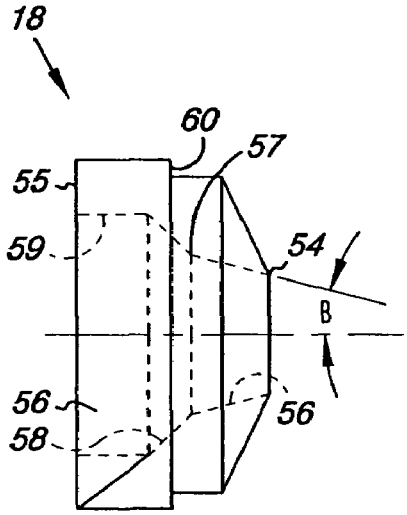
FIG. 7 is an elevational side view of the air atomizing cap of the air atomizer assembly of the present invention.
Figure 8:
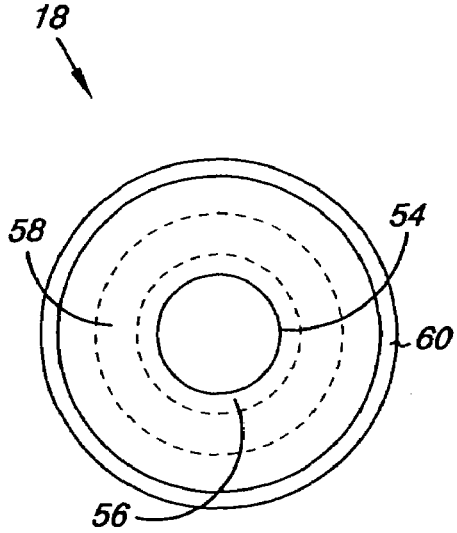
FIG. 8 is an elevational front end view of the air atomizing cap of FIG. 7.

The air atomizing cap 18 is shown best in FIGS. 7 and 8. The cap has a forward end or edge 54, a rearward end 55 and an interior surface extending from the forward end 54 to the rearward end 55. This interior surface includes a first frustoconical surface portion 56, a second frustoconical surface portion 58 and a rearward, generally cylindrical surface portion 59. As shown, the first frustoconical surface portion 56 extends from the forward end 54 rearwardly to a point 57 where it joins with the forward end of the second frustoconical surface portion 58. The surface portion 59 extends forwardly from the rearward end 55 and joins with the rearward end of the surface portion 58.

As shown best in FIG. 7, the angle "B" which the frustoconical surface portion 56 forms with the axis 13 is less than that of the frustoconical surface 58. Preferably, the surface portion 56 has a frustoconical angle "B" matching that of the exterior frustoconical surface 36 of the mixer tip 16. Accordingly, it is preferably at least about 5 degrees, more preferably at least about 10 degrees and most preferably about 15 to 25 degrees.

Figure 3:
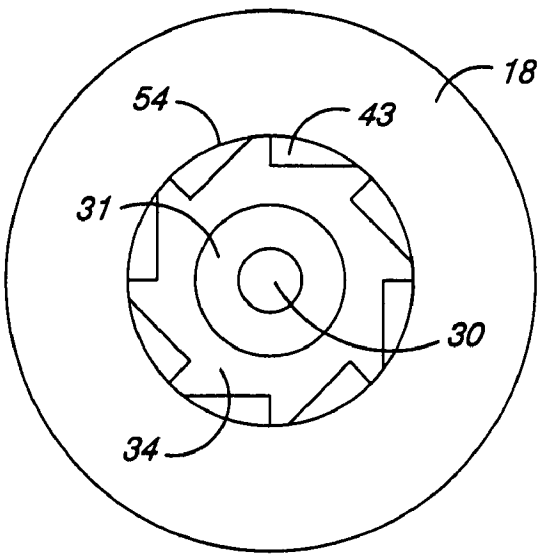
FIG. 3 is an enlarged elevational end view of the forward or nozzle end of the mixer assembly.

When the air atomizing cap 18 is assembled in operational position with the mixer tip 16 as shown in FIGS. 2 and 3, the interior frustoconical surface portion 56 engages and mates with a portion of the exterior frustoconical surface 36 to form a plurality of passageways 43 (FIG. 3) defined by the grooves 40. Preferably the length of the passageways 43 is no less than about 3/16 of an inch and preferably no less than the diametrical dimension of the surface portion 56 at the forward end 54. Most preferably, the axial length of the surface portion 56 from the forward end 54 to the point 57, relative to the cross-sectional configuration and size of the passageways 43 should be sufficient to create laminar flow within such passageways 43.

Because the angle which the frustoconical surface portion 58 forms with the axis 13 is significantly larger than the angle "B", the surface portion 58 and surface 59 are spaced outwardly from the corresponding area of the surface portion 36 of the tip 16 (FIG. 4), thereby creating a flow area to provide atomizing fluid to the passageways 43.

The rearward end 55 of the atomizing cap 18 is generally annular and is perpendicular to the axis 13. When the device of the present invention is assembled, the surface 55 seats against the forward end of the air nozzle body 15 as described below. The exterior surface of the atomizing cap 18 is provided with a retaining shoulder 60 which mates with corresponding structure of the retaining nut 19 to retain the atomizing cap 18 in an assembled position relative to the air nozzle body 15 and thus the mixture body 11.

Figure 9:
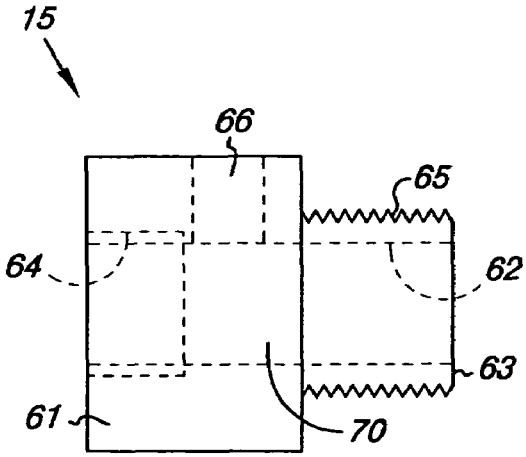
FIG. 9 is an elevational side view of the air nozzle body.
Figure 10:
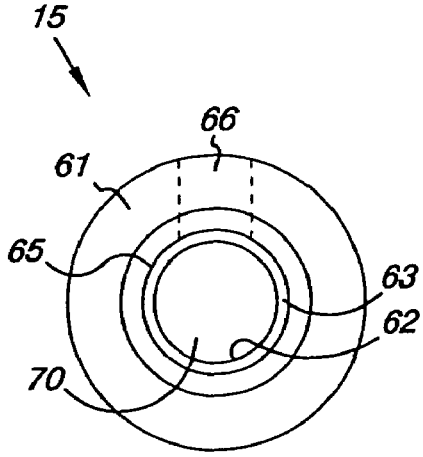
FIG. 10 is an elevational front end view of the air nozzle body shown in FIG. 9.

The air nozzle body 15 which is shown generally in FIG. 1 and in greater detail in FIGS. 9 and 10 includes a generally cylindrical main body portion 61 having an inner surface 62 defining a generally hollow interior chamber 70. The rearward end of the main body 61 is provided with a plurality of interior threads 64 to connect with the threads 25 at the forward end of the body 11. A nipple 63 with external threads 65 extends forwardly from the main body 61 for connection with the retaining nut 19. An atomizing fluid inlet port 66 is provided in the side of the main body portion 61. The port 66 communicates with the interior chamber 70 and is provided with interior threads for connection to a source of pressurized atomizing air (not shown). For application of a single component material, the mixer tube 12 can be replaced by a material supply tube.

The retaining nut 19 (FIG. 11) includes a plurality of interior threads 68 at its rearward end and a retaining shoulder 69 near its forward end. When assembled, the interior threads 68 are received by the exterior threads 65 of the nipple portion 63 and the shoulder 69 engages the retaining shoulder 60 of the atomizing cap 18. Accordingly, the retaining nut retains the cap 18 and thus the tip 16 to the nozzle body 15 and thus the mixer body 11.

When assembled in this manner as shown best in FIG. 2, an atomizing fluid chamber 70 is provided within the nozzle body 15 to provide atomizing fluid to the spiral passageways 43 (FIG. 3) formed by the grooves 40 in combination with the inner frustoconical surface 56 of the cap 18. When pressurized atomizing air is provided to the chamber 70, this air exits the passageways 43 at the forward end 34 of the tip 16 in generally flat, converging and spiraling streams.

As application fluid or material is discharged through the nozzle tip 30 from a pressurized source, the flat, converging and spiraling streams of atomizing fluid contact the discharged application fluid stream and dispenses or atomizes the stream into tiny droplets. Although applicant does not wish to be bound by any particular theory, it is believed that because of the generally flat shape or configuration of the atomizing air flow streams as they exit the atomizing nozzle assembly, the application fluid stream is subjected to shear forces and thus provides more thorough and complete atomization, particularly for fluids which are highly viscous and/or exhibit a high tensile strength. Preferably, the circumferential dimension "cd" of the recesses 42 (and thus passageways 43) at the forward end of the tip 16 is greater than the radial dimension "rd", more preferably twice as great and most preferably about three times as great.

Figure 13:
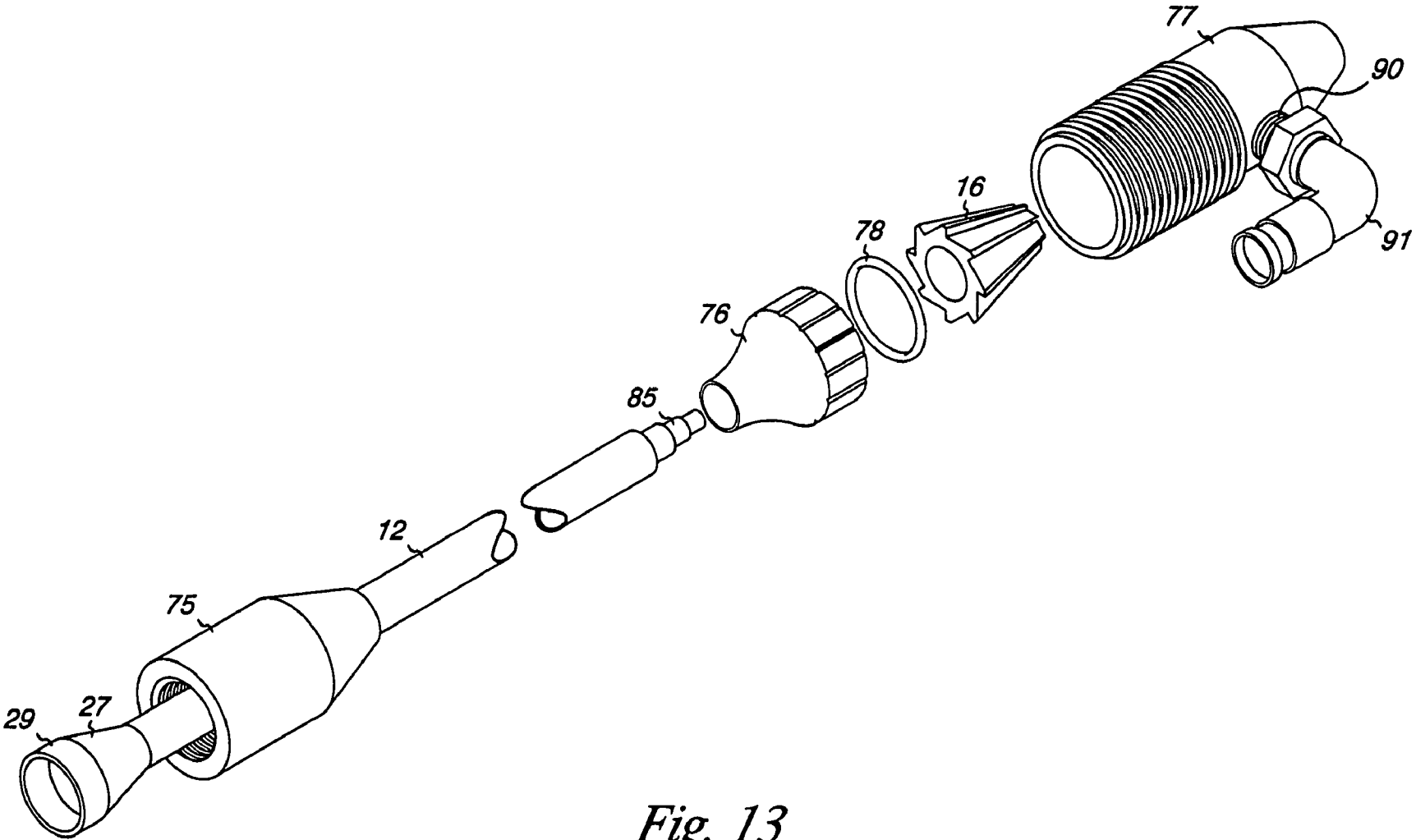
FIG. 13 is an isometric, fragmentary view of a further embodiment of a fluid application assembly of the present invention.
Figure 14:
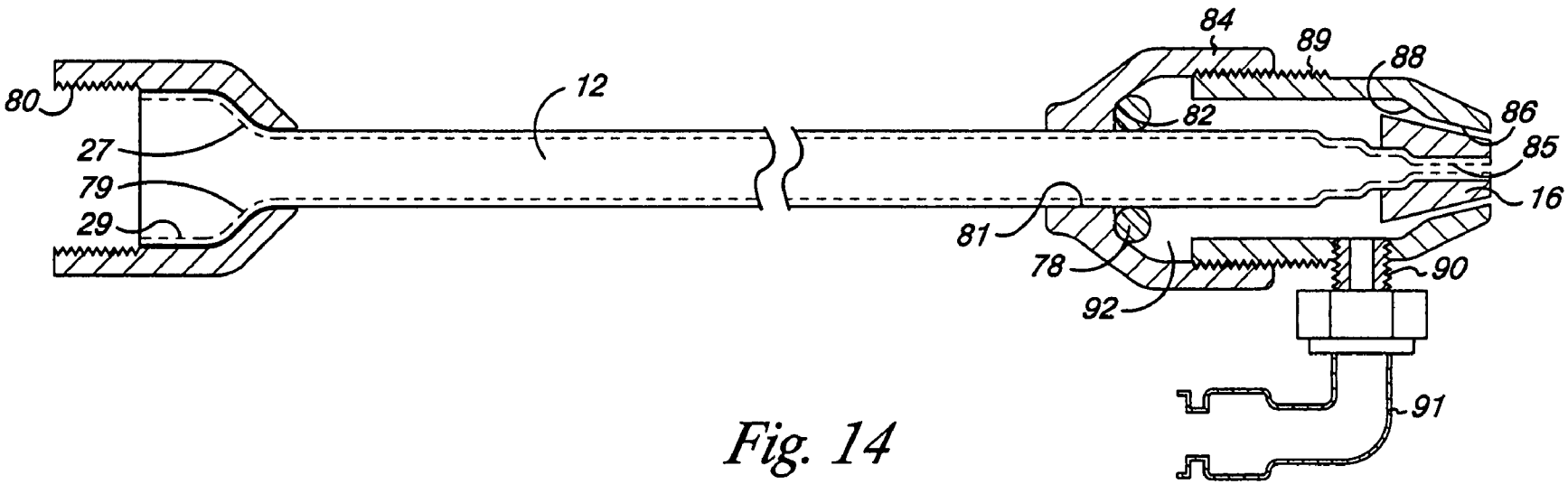
FIG. 14 is a view, partially in section, of the fluid application assembly of FIG. 13.

A further embodiment of a spray head and mixer assembly is shown in FIGS. 13 and 14. In this embodiment, the mixer body 11 of FIG. 1 is replaced by the pair of nuts 75 and 76 and the rubber O-ring retaining grommet 78. As shown, the mixer tube 12 includes a rearward end similar to that of FIG. 1 with a beveled seat portion 27 and rearward annular portion 29. The rear nut 75 is a connection nut which is slipped onto the tube 12 at its forward end and includes an inner beveled surface 79 to seat against the beveled seat portion 27. The nut 75 includes internal threads 80 for connection to a supply of pressurized application fluid (not shown).

The nut 76 is a retaining nut which includes a rearward cylindrical portion 81 having a diametrical dimension approximating or slightly larger than the exterior diameter of the tube 12. Immediately forward of the portion 81 is an interior surface designed to seat against a retaining member in the form of the O-ring grommet 78. The forward end of the nut 76 includes internal threads for connection to the air cap assembly 77.

The O-ring grommet 78 is slipped onto the mixing tube 12 after the nuts 75 and 76 have been slipped on and preferably has an internal diameter slightly smaller than that of the tube 12. When applied to the tube 12, the grommet 78 has sufficient stiffness and there is sufficient friction between the grommet 78 and the tube 12 to retain the nut 76 when tightened against the air cap assembly 77. If needed or desired, a second O-ring grommet or other retaining member can be provided. The grommet 78 or other retaining member is preferably selectively removable from the tube 12 and functions to retain the nut for the purpose intended.

The embodiment of FIGS. 13 and 14 is provided with an air manifold or mixer tip 16 at the forward end 85 of the tube 12. The tip 16 is the same as the tip 16 shown and described with respect to the embodiment of FIG. 1 and is sized to fit over the end 85 so that the forwardmost end surface of the end 85 is substantially flush with the forwardmost end surface of the tip 16.

The air cap assembly 77 includes inner conical surfaces 86 and 88 similar to the conical surfaces 56 and 58 of FIG. 7. Like the surfaces 56 and 58 of FIG. 7, the surfaces 86 and 88 cooperate with the outer surface of the mixer tip 16 to provide a plurality of atomizing air flow passages. The rearward end of the assembly 77 includes external threads 89 for connection to the retaining nut 76 as shown. An externally threaded top 90 is threadedly received by a port in the body of the assembly 77 to connect an air supply fitting 91. The fitting 91 is designed for connection to a supply of atomizing air (not shown).

When connected with the mixer tube 12, the nut 76 and the assembly 77 define an atomizing air chamber 92 to provide atomizing air to the passages between the tip 16 and the conical surfaces 86 and 88. This embodiment provides a spray head construction in which the body 11 can be eliminated and in which the atomizing assembly comprised of the nut 76, the assembly 77 and the tip 16 can be easily changed for cleaning or for replacement or the like. Further, all of the air atomizing components of the embodiment of FIGS. 13 and 14 can be constructed of plastic and injection molded. The components can also be made of other materials such as light weight metals.

In addition to the air atomizing assembly of the preferred embodiment and related equipment illustrated in FIGS. 1–14, various other air atomizing embodiments and systems in accordance with the present invention are illustrated in FIGS. 15–24. In FIGS. 15–24, only the atomizing assembly (or a portion thereof in the form of the tip 16 and the cap 18) is illustrated, it being understood that such atomizing assemblies can be used with a mixer tube and assembly such as that illustrated in FIGS. 1–14 above or with an application fluid supply tube or any other means currently known in the art or hereinafter known in the art for supplying pressurized application fluid to the atomizing assembly.

In the embodiment of FIGS. 1–14, the atomizing assembly included an inner atomizing tip with an outer generally frustoconical surface and an outer atomizing cap with a complimentary inner generally frustoconical surface. In such embodiment, a plurality of grooves were shown as being formed on the outer frustoconical surface of the atomizing tip which, when assembled with the cap, formed a plurality of atomizing fluid passageways or flow channels with a specific configuration, namely, passageways or channels which spiral and which have a flattened configuration with a circumferential dimension at least twice the radial dimension.

Figure 12:
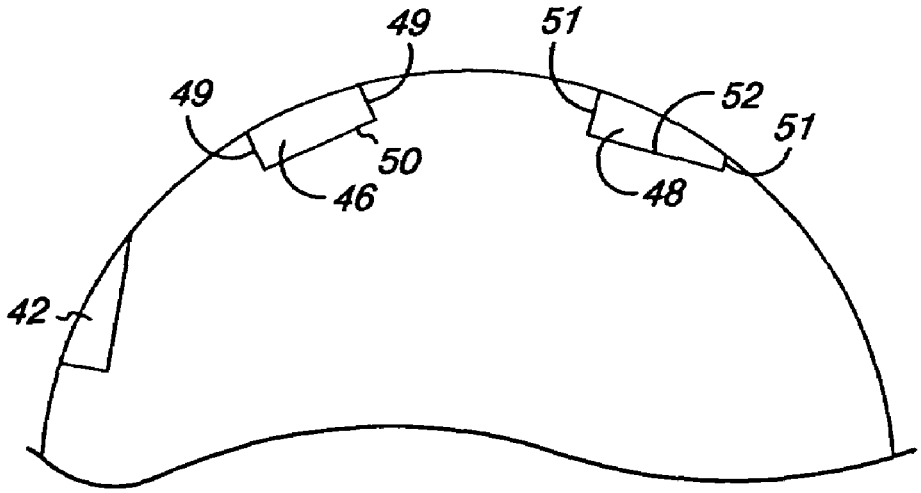
FIG. 12 is a view showing a variety of cross-sectional configurations of the spiral airflow grooves in the mixer tip of the present invention.
Figure 26:
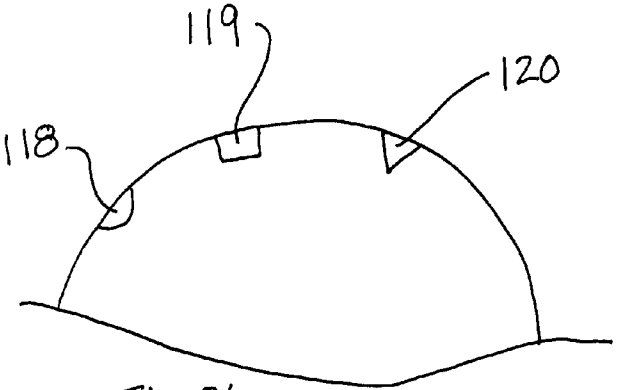
FIG. 26 is a view, similar to FIG. 12, showing various alternate cross-sectional configurations of airflow grooves.

The present invention contemplates, however, that such grooves could be formed either in the outer frustoconical surface of the atomizing tip or the inner frustoconical surface of the atomizing cap and that the surfaces in which the grooves are formed could comprise configurations other than conical or frustoconical and that the grooves could be straight, spiraled or curved and could be of a variety of configurations. For example, the grooves that define the atomizing air channel could be straight, non-spiraled grooves and could be formed in surfaces that are not conical or frustoconical. Further, unlike the embodiment of FIGS. 1–14 in which the grooves have a cross-sectional configuration such as those shown in FIG. 12, a variety of other cross-sectional configurations may be used as well. Specifically, FIG. 26, a figure similar to FIG. 12, shows a variety of such other configurations. These include a generally circular or semi-circular configuration 118, a square configuration 119, a triangular configuration 120, or any other cross-sectional configuration that will result in atomizing the application fluid.

Figure 15:
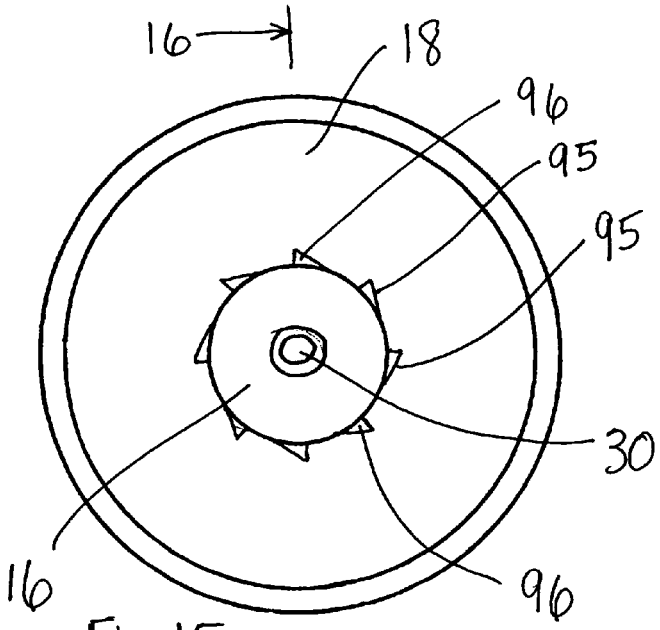
FIG. 15 is an elevational end view of a further embodiment of an air atomizing assembly in accordance with the present invention.
Figure 16:
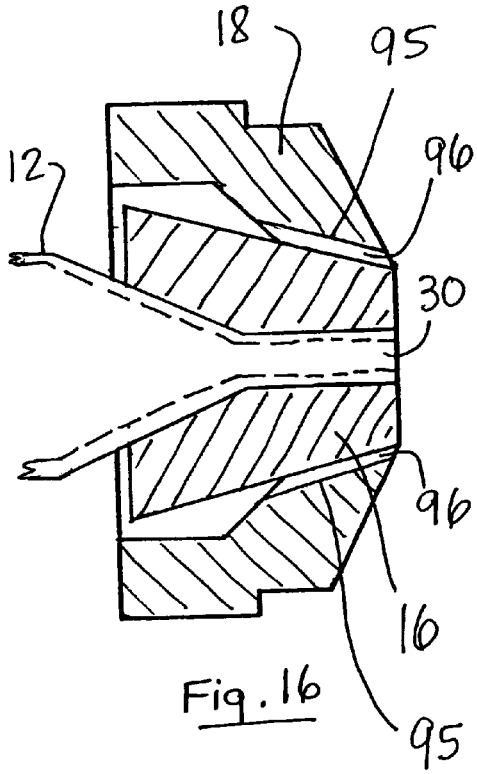
FIG. 16 is a view, partially in section, as viewed along the section line 16—16 of FIG. 15.

FIGS. 15 and 16 show an embodiment in which the plurality of grooves 95 are formed on the inner frustoconical surface of the cap 18. Thus, when the cap 18 of FIGS. 15 and 16 is assembled with the atomizing tip 16, a plurality of passageways or flow channels 96 are formed by the grooves 95 in combination with the outer frustoconical surface of the tip 16.

Further, although the preferred embodiment shows the outer and inner surfaces of the tip and cap as frustoconical, there is no requirement that such surfaces be limited to that shape. As described below with respect to FIGS. 18–20, such surfaces can form various shapes as long as the channels formed therein function to atomize the application fluid as desired.

Thus, a feature of the present invention can be characterized as comprising a first atomizing member having an outer surface portion and a second atomizing member having an inner surface portion of a size and configuration substantially matching that of the outer surface portion, with one of the inner and outer surface portions having a plurality of grooves extending from its rearward end toward its forward end to define passageways or flow channels when such surfaces are assembled into engagement with one another.

Figure 17:
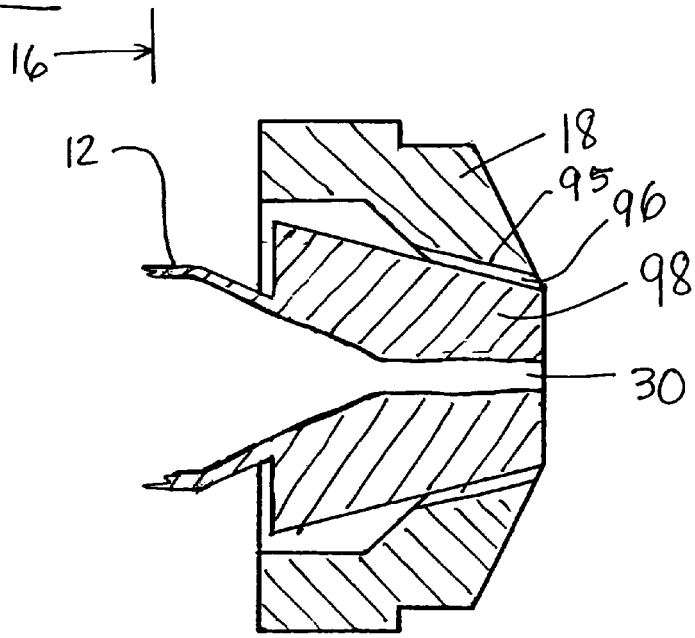
FIG. 17 is a view, partially in section, showing a further embodiment of an air atomizing assembly in accordance with the present invention.

The embodiment of FIG. 17 is similar to the embodiment of FIGS. 15 and 16 in that the grooves 95 which form the flow channels 96 are formed in the inner surface portion of the cap 18. Such embodiment, however, differs from the embodiments of FIGS. 15 and 16 as well as the embodiments of FIGS. 1–14 in that the atomizing tip or first atomizing member 98 is formed as an integral portion of the end of the mixing or fluid supply tube 12. Thus, when the structure of the atomizing assembly in accordance with the present invention is described as having an inner or first atomizing member with an outer surface, such member can be a separate and distinct element such as the atomizing tip 16 shown in the embodiments of FIGS. 1–16 or can be an element 98 which is integrally formed with the mixing tube 12 such as shown in FIGS. 17 or integrally formed with a supply tube or other means for supplying pressurized application fluid to an outlet nozzle. If desired, the cap 18 of FIG. 17 can be a snap-on cap which is injection molded and which is retained relative to the member 98 by an "O" ring or other retaining means.

Figure 18:
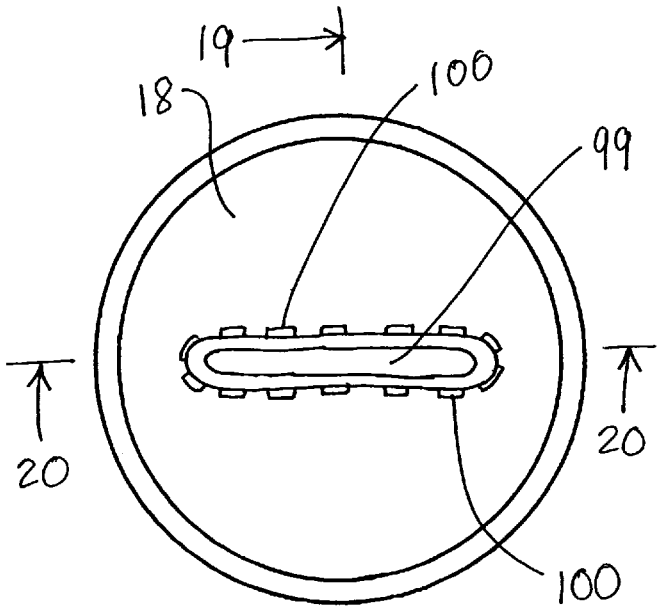
FIG. 18 is an elevational end view of a further embodiment of an air atomizing assembly in accordance with the present invention.
Figure 19:
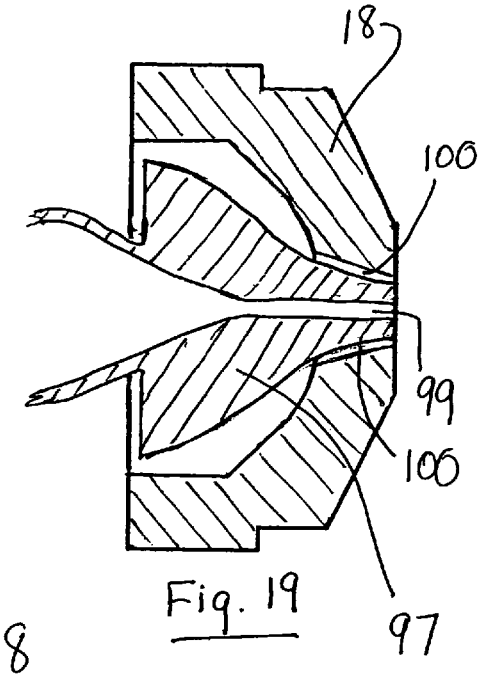
FIG. 19 is a view, partially in section, as viewed along the section line 19—19 of FIG. 18.
Figure 20:
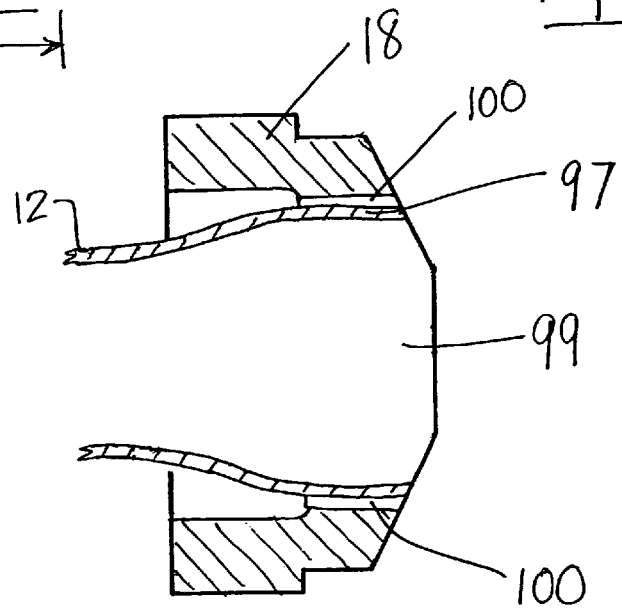
FIG. 20 is a view, partially in section, as viewed along the section line 20—20 of FIG. 18.

In the embodiment of FIGS. 1–14, the outer surface of the atomizing tip 16 and the inner surface of the atomizing cap 18 are described as being generally frustoconical surfaces. While such a surface configuration is preferred, it is contemplated that various other surface configurations could be utilized as well. For example, the outer and inner surfaces of the atomizing tip and cap, respectively, could converge inwardly toward the nozzle opening and have a generally elliptical or other elongated cross-section. For example, as shown in the embodiment of FIGS. 18, 19 and 20, the outer and inner surfaces of the tip 16 and cap 18 could extend rearwardly from a generally elongated nozzle opening 99. In the embodiments of FIGS. 18–20, like the embodiments of FIGS. 15–17, the inner surface of the cap 18 is provided with a plurality of grooves to form the flow passages 100, although such grooves could be formed in the outer surface of the tip 16, if desired. Also, although FIG. 20 shows the supply tube 12 as curving inwardly as it extends rearwardly from the opening 99, such tube 12 could extend rearwardly in a substantially straight line. With the elongated nozzle opening 99, the embodiment of FIGS. 18–20 is particularly applicable for achieving relatively wide spray or application patterns.

The flow channels 100 of FIGS. 18–20 are preferably flattened channels as described above. Although each of the channels 100 can lie in a plane extending through the nozzle opening 99, the channels 100 are preferably sloped relative to such a plane. In the preferred embodiment, the set of channels 100 on one side of the nozzle opening 99 slope in one direction and the set of channels 100 on the other side of the nozzle opening slope in the opposite direction.

In general, the shape of the outer and inner surfaces of the first and second atomizing members in accordance with the present invention can assume a variety of shapes and configurations. Preferably, however, such inner and outer surfaces should preferably have complimentary dimensions and configurations for a length at least equal to the diameter of the nozzle opening. Further, such inner and outer surfaces should preferably have a cross-sectional configuration similar to the shape of the orifice. Specifically, if the orifice is elongated, the cross-sectional configuration of the inner and the outer surfaces should be elongated.

FIGS. 21, 22, 23 and 24 disclose means in combination with an air atomizing assembly, for breaking up the flow stream of the application fluid and thus assisting in the atomization of the application fluid to facilitate larger flow rates and, in some cases, to reduce the application pressure of the application fluid.

In certain spray application environments, the flow stream of the application fluid is relatively large due to the nature of the application fluid itself or the desire to increase the efficiency of the application process, among others. Such large flow streams, particularly flow streams of high viscosity fluids or high surface tension fluids such as epoxies, urethanes, polyureas and other adhesives, are difficult to spray or break up with atomizing air alone and often require relatively large application pressures. In many spray environments, this necessarily limits the maximum flow rate of fluid that can be satisfactorily atomized and applied and the equipment with which such fluid can be satisfactorily applied.

Figure 21:
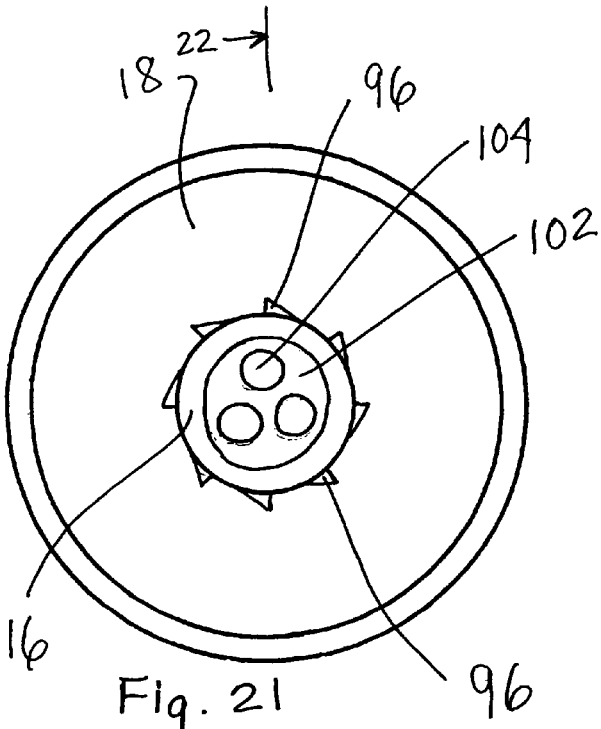
FIG. 21 is an elevational end view of a further embodiment of an air atomizing assembly in accordance with the present invention.
Figure 22:
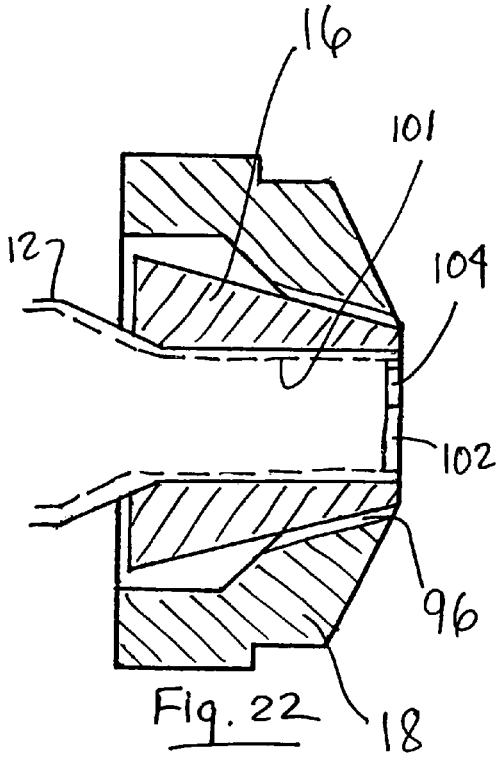
FIG. 22 is a view, partially in section, as viewed along the section line 22—22 of FIG. 21.

In the embodiment of FIGS. 21 and 22, a relatively large nozzle orifice 101 (FIG. 22) is provided with a flow diverter or diverter orifice 102. The diverter orifice 102 is essentially a wall or another obstruction in the flow nozzle, or upstream of the flow nozzle, which causes the flow stream to break up into a plurality of smaller flow streams as it leaves the nozzle opening. In FIGS. 21 and 22, the diverter 102 includes a plurality of smaller orifices 104. When pressurized fluid is introduced into the flow tube 12, the diverter 102 causes the fluid in the orifice nozzle 101 to flow through the plurality of orifices 104. Such diverter, or other obstruction can be located at the nozzle opening as shown or can be anywhere upstream from the nozzle opening. This breaks up the single flow of material within the orifice 101 into smaller multiple streams of material through the orifices 104. This improves the ability of the atomizing air to further break up and atomize the material in the multiple flow streams, thus enabling application of greater flow rates with the same atomizing air and, in some cases, lower application pressures.

Figure 23:
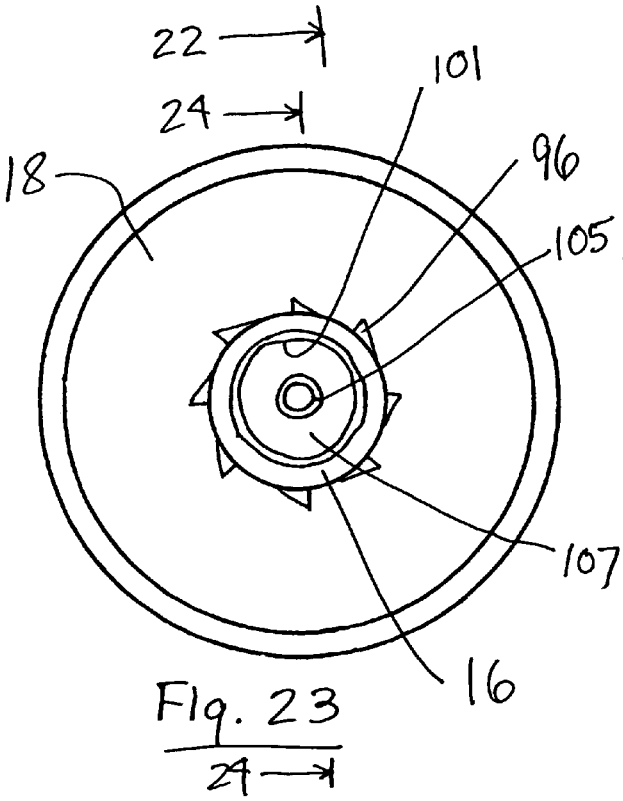
FIG. 23 is an elevational end view of a further embodiment of an air atomizing assembly in accordance with the present invention.
Figure 24:
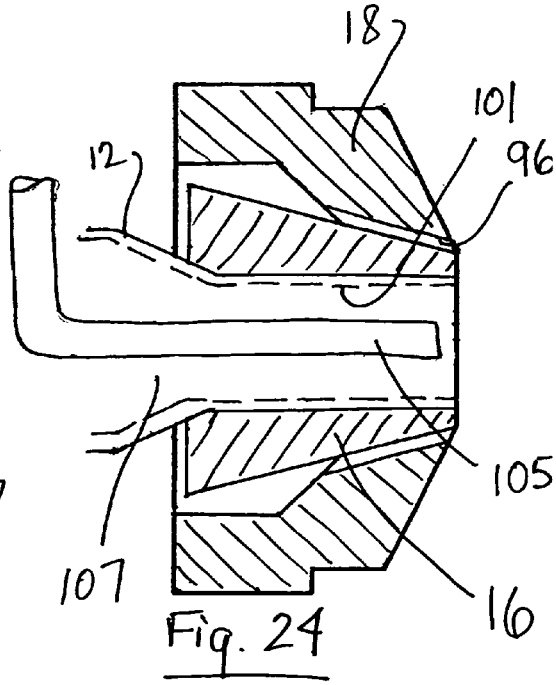
FIG. 24 is a view, partially in section, as viewed along the section line 24—24 of FIG. 23.

FIGS. 24 and 23 show a further embodiment for breaking up a relatively large application fluid flow stream to facilitate more efficient atomization. In FIGS. 23 and 24, an air stream is directed to a point within the application fluid flow stream itself. This air stream may be an independent air stream or, as shown in the preferred embodiment, be part of the atomizing air. Further, the air stream may be atmospheric or any other gas such as nitrogen ($N_2$), or carbon dioxide ($CO_2$) or any other fluid which will function to break up the application fluid stream and/or reduce its viscosity as it flows through the supply tube 12.

In FIGS. 23 and 24, the preferred air stream is a portion of the atomizing air flow which is directed from the atomizing air chamber or source into the central portion of the application fluid stream 107 via the conduit or flow tube 105. During operation, this air stream flows through the tube 105 and into the central portion of the fluid stream 107. This tends to break up or disperse the flow stream 107, thereby facilitating easier and more efficient atomization with the atomizing air. This in turn improves the flow rate of the application fluid and thus increases the application efficiency with substantially the same amount of atomizing air. This also results, in some cases, in a reduction of the application fluid pressure required to apply the application fluid at a specific flow rate.

Thus, a further feature of the present invention includes means in the form of a flow breakup member positioned within the application flow stream and preferably at or near the orifice opening, but anywhere upstream of such opening, for breaking up the flow stream into smaller, more easily atomized flow streams. In some cases, particularly with the embodiment of FIGS. 23 and 24, the tube 105 can be positioned significantly upstream from the nozzle opening such as at or near the source of pressurized application fluid. Preferably the air or other fluid flow introduced through the tube 105 is introduced in the downstream direction at a point upstream from the nozzle opening.

Figure 25:
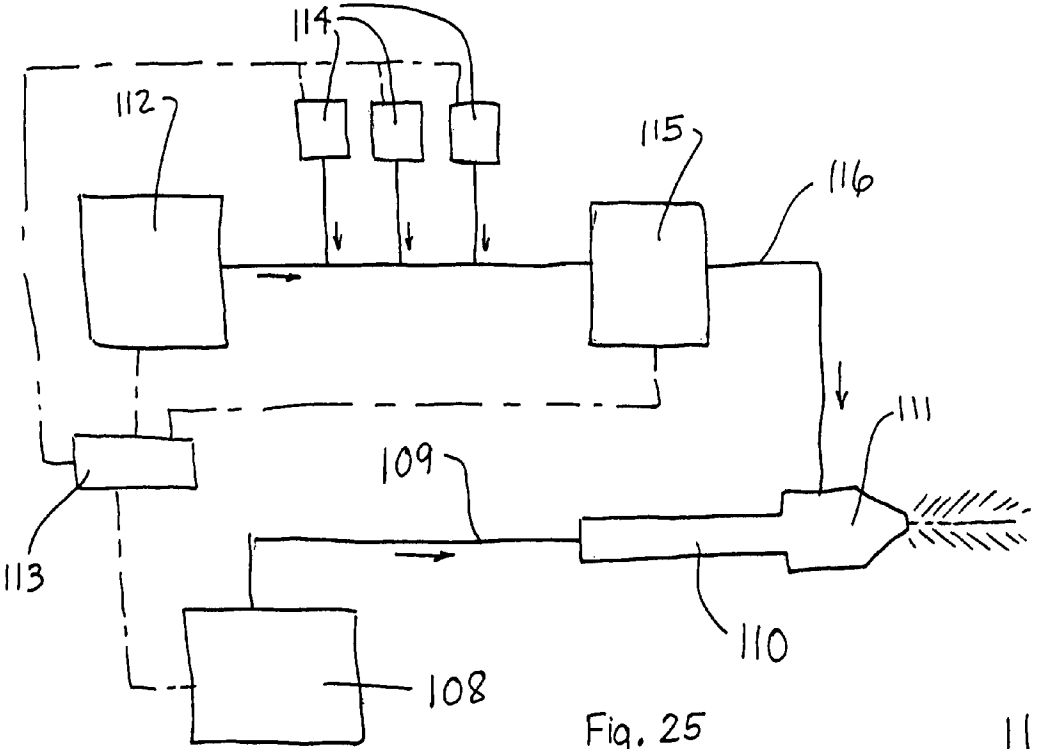
FIG. 25 is a schematic diagram showing an apparatus and system for providing pressurized application fluid and pressurized atomizing air to a nozzle assembly in accordance with the present invention.

In FIGS. 21 and 22, this break up member is the flow diverter 102 or other flow breakup structure. In FIGS. 24 and 25, this member comprises the flow tube 105 for introducing a flow stream of gas or other fluid upstream from the nozzle opening. This gas or fluid may be a portion of the atomizing air or may be from an independent source.

The method aspect of the present invention relates to a method of utilizing the atomizing air as a vehicle for introducing a curing agent, catalyst or other component into the application fluid or to otherwise condition the application fluid.

Many application fluids, and in particular adhesives and other high viscosity and high surface tension materials, are moisture cured. For example, most one-part silicon adhesives and most one-part urethane adhesives are moisture cured. This means that the presence of moisture in contact with the application fluid initiates the curing process. In the current art, it is common to apply the application fluid to a substrate and then apply moisture to the surface thereof to initiate the curing process. This has drawbacks, however, in that the moisture is not thoroughly mixed with the applied fluid and a skin comprised of cured application fluid tends to form on the surface of the applied fluid. However, by introducing moisture into the atomizing air, such moisture becomes thoroughly mixed with the application fluid, resulting in more complete and uniform curing. Introduction of moisture into the atomizing air also eliminates the extra step of applying the moisture to the substrate after application of the fluid.

Further, some resin systems require a curing catalyst or agent other than moisture to initiate the curing process. In accordance with the present invention, such curing catalysts or other agents can also be introduced via the atomizing air stream. This thoroughly mixes the catalyst or other agent with the application fluid and initiates the curing process immediately upon application.

Still further, for two-part application fluid systems, the atomizing air stream can be used to introduce and mix one part or component of the system with the other part or component of the system which is applied through the nozzle outlet.

A still further method in accordance with the present invention is to utilize the atomizing air to condition the application fluid. For example, in some application fluid systems, the viscosity of the application fluid and the cure rate of the application fluid can be controlled by controlling the temperature of the application fluid. This is commonly done by providing heating and/or cooling means in the application fluid supply line to heat the fluid to the desired temperature. In accordance with the present invention, however, the atomizing air is heated or cooled. This results in corresponding heating or cooling of the application fluid during atomization, thereby providing a means for controlling the viscosity and/or cure rate of the application fluid.

The system for performing the method aspect of the present invention described above is shown in FIG. 25. Such system includes a source of pressurized application fluid 108 for providing pressurized application fluid through the line 109 to the delivery means 110. The delivery means 110 includes a spray and atomizing nozzle 111 which may be similar to that described above or which may comprise any conventional spray or delivery air atomizing means currently or hereinafter known in the art. The system also includes a source of pressurized atomizing air or other atomizing gas or fluid 112 which is delivered via the line 116 to the atomizing means 111. The system also includes one or more supply vessels or other means 114 for selectively supplying secondary material to the atomizing air in the line 116 for ultimate delivery to the nozzle assembly 111 and mixing with the application fluid. As described above, such secondary component may include water or other fluid for introducing moisture into the line 116 for a moisture cured system. Such secondary component may also include other curing agents or catalysts or may also include a second component in a two-component application fluid system. Such moisture or other curing agent or catalyst is preferably introduced in a quantity sufficient to fully, or at least partially, cure the application fluid delivered through the nozzle orifice.

Such system also includes an inline heater/cooler means 115 for selectively heating or cooling the atomizing gas or fluid in the line 116 to a desired temperature. Thus, via the heater/cooler means 115, the atomizing gas or fluid can be conditioned to the desired temperature to thereby control the viscosity and/or the rate of cure of the application fluid. Appropriate control means 113 may be included in the system of FIG. 25 to control the flow of application fluid, the flow of atomizing gas or fluid, the selected flow of one or more secondary components from the supplies 114 and the selected temperature of the atomizing gas or fluid via the heater/cooling means 115.

Although the description of the preferred embodiment has been quite specific, it is contemplated that various modifications could be made without deviating from the spirit of the present invention. Accordingly, it is intended that the scope of the present application be dictated by the appended claims rather than by the description of the preferred embodiment.

The invention claimed is:

1. A method of delivering an application fluid to a substrate comprising:

providing an air atomized delivery system having a source of pressurized application fluid, an application fluid supply tube with a nozzle opening at one end, an air atomizing assembly and a source of pressurized atomizing air;

delivering application fluid from said source of application fluid and in a flow stream through said application fluid supply tube and out through said nozzle opening;

atomizing said application fluid with said atomizing air after said application fluid flows out through said nozzle opening; and introducing a gaseous fluid into the application fluid internally within said flow stream and in said supply tube at a point upstream from said nozzle opening to further assist in atomization of said application fluid.

2. The method of claim 1 wherein said gaseous fluid is introduced in a downstream direction toward said nozzle opening.

3. The method of claim 1 wherein said gaseous fluid includes at least a portion of said atomizing air.

4. The method of claim 1 wherein said gaseous fluid is different from said atomizing air.

5. The method of claim 2 wherein said gaseous fluid includes at least a portion of said atomizing air.

6. The method of claim 1 including mixing one or more of a curing agent, a curing catalyst or an application fluid component with said application fluid by introducing said one or more of said curing agent, curing catalyst or application fluid component into said atomizing air.

7. The method of claim 6 wherein said application fluid is a moisture cured application fluid and said one or more of said curing agent, curing catalyst or application fluid component is moisture in an amount sufficient to cure said delivered application fluid.

8. The method of claim 7 wherein said application fluid is a moisture cured adhesive.

9. The method of claim 6 wherein said application fluid is a two component part application fluid and said one or more of said curing agent, curing catalyst or curing component is one component of said two component part application fluid.

10. The method of claim 1 including heating or cooling said atomizing air prior to delivery to said air atomizing assembly.

11. The method of claim 10 wherein said application fluid includes an application viscosity and the method includes controlling the application viscosity of said application fluid by said heating or cooling step.

12. The method of claim 10 controlling the application cure rate of said application fluid by said heating or cooling step.

13. The method of claim 10 including controlling the application viscosity and the application cure rate of said application fluid by said heating or cooling step.

14. The method of claim 1 wherein said supply tube includes first and second ends and said gaseous fluid is introduced into said supply tube between said first and second ends.

15. The method of claim 14 wherein said deliver system includes a flow tube extending into said supply tube between said first and second ends and wherein said gaseous fluid is introduced through said flow tube.

16. The method of claim 1 wherein said delivery system includes a flow tube extending into said supply tube and wherein said gaseous fluid is introduced through said flow tube.

17. The method of claim 2 wherein said delivery system includes a flow tube extending into said supply tube and wherein said gaseous fluid is introduced through said flow tube.

18. The method of claim 3 wherein said delivery system includes a flow tube extending into said supply tube and wherein said gaseous fluid is introduced through said flow tube.

19. A method of delivering an application fluid to a substrate comprising:

providing an air atomized delivery system having a source of pressurized application fluid, an application fluid supply tube with a nozzle opening at one end, an air atomizing assembly and a source of pressurized atomizing air;

delivering application fluid from said source of application fluid and in a flow stream through said application fluid supply tube and out through said nozzle opening;

atomizing said application fluid with said atomizing air after said application fluid flows out through said nozzle opening; and introducing a gaseous fluid into the application fluid internally within said flow stream and said supply tube at or near said nozzle opening to further assist in atomization of said application fluid.

20. The method of claim 19 wherein said gaseous fluid is introduced at said nozzle opening.

21. The method of claim 19 wherein said gaseous fluid is introduced in a downstream direction and includes at least a portion of said atomizing air.

* * * * *